United States Patent [19]

Diamond

[11] Patent Number: 4,498,621

[45] Date of Patent: Feb. 12, 1985

[54] COMBINED MAILBOX AND SUPPORTING POST

[76] Inventor: Jeffrey S. Diamond, 330 Brazilian Ave., Palm Beach, Fla. 33480

[21] Appl. No.: 585,372

[22] Filed: Mar. 2, 1984

[51] Int. Cl.[3] ..... B65D 91/00

[52] U.S. Cl. ..... 232/35; 232/39; 232/17

[58] Field of Search ..... 232/17, 34, 35, 39, 232/37, 38, 1 C

[56] References Cited

U.S. PATENT DOCUMENTS

| | | | |
|---|---|---|---|
| 657,356 | 9/1900 | Orendorff | 232/17 |
| 759,437 | 5/1904 | Harward | 232/39 |
| 1,232,616 | 7/1917 | Shinn | 232/34 |
| 1,293,439 | 2/1919 | Honig | 232/34 |
| 1,487,372 | 3/1924 | Cobel | 232/39 |
| 2,781,964 | 2/1957 | Ledgerwood | 232/17 |
| 3,343,785 | 9/1967 | Gegax et al. | 232/35 |
| 3,580,491 | 8/1968 | Campbell | 232/17 |
| 3,667,405 | 6/1972 | Roach, Jr. | 232/39 |
| 3,735,919 | 5/1978 | Morgan | 232/17 |
| 4,186,869 | 2/1980 | Brown | 232/17 |

*Primary Examiner*—Gene Mancene
*Assistant Examiner*—Kris R. Schulze
*Attorney, Agent, or Firm*—Cushman, Darby & Cushman

[57] ABSTRACT

A mailbox receptacle is combined with a supporting post, on which it forms an upper portion characterized by a floor extending transversally across the interior of the tubular post at a level spaced somewhat below the upper end. A lateral opening is provided into the interior space above the floor, and a tubular sleeve is coaxially rotatably mounted on the upper end region of the structure. The tubular sleeve has a lateral opening which registers with the receptacle opening in one orientation of the sleeve. And the tubular sleeve may be rotated to fully close the receptacle opening. Stops are provided to define the angular extremes of rotary movement of the tubular sleeve, and the sleeve or a cap structure provided on the post over the sleeve may include a signal flag which, particularly in the latter case, may be caused to operate in conjunction with rotation of the sleeve in the course of opening or closing the receptacle. In one version, the sleeve rides on an upwardly facing circumferential shoulder defining the lower extent of a recessed portion of the post structure, so that the mailbox portion protrudes insignificantly radially outwards from the post portion of the post structure. Preferably the structure is made of a durable synthetic plastic resin.

20 Claims, 6 Drawing Figures

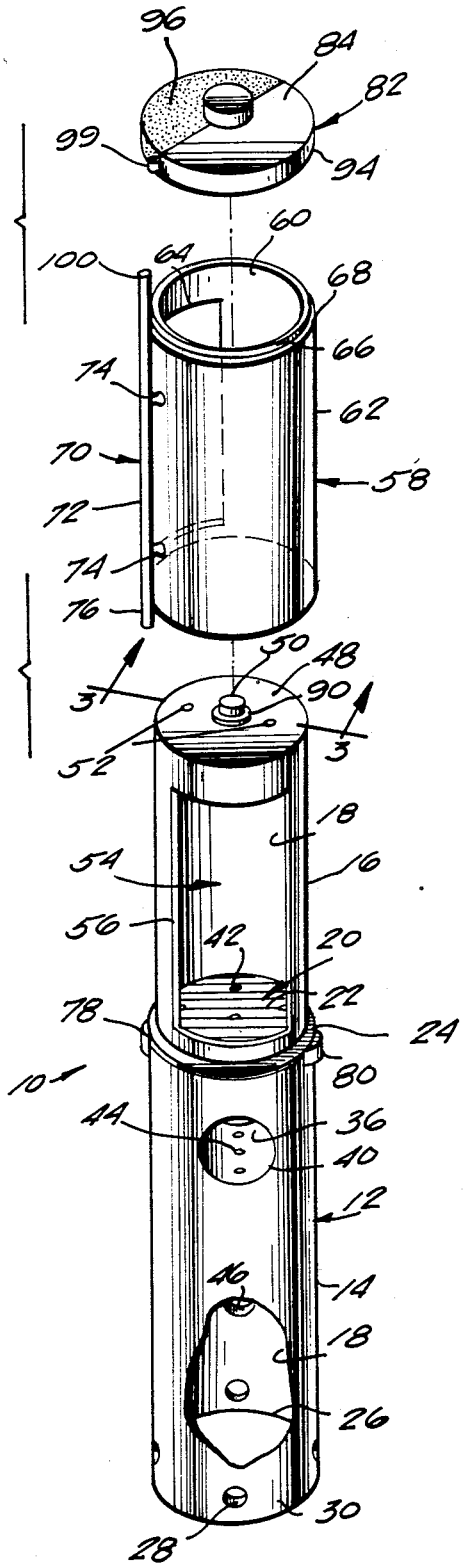
Fig. 1
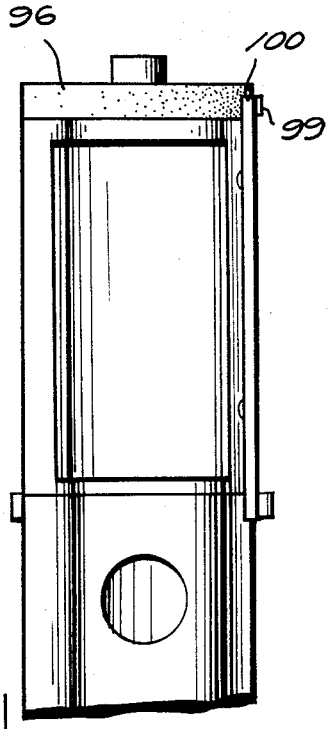
Fig. 2
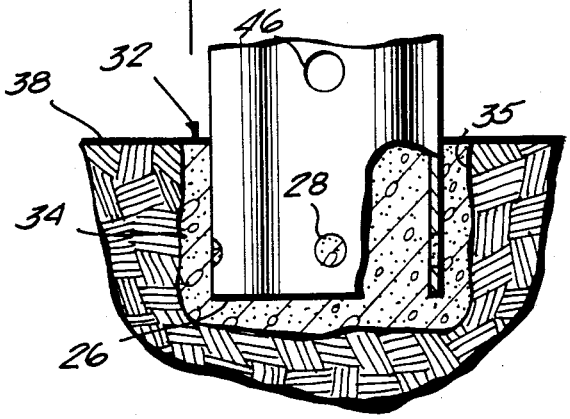
Fig. 3
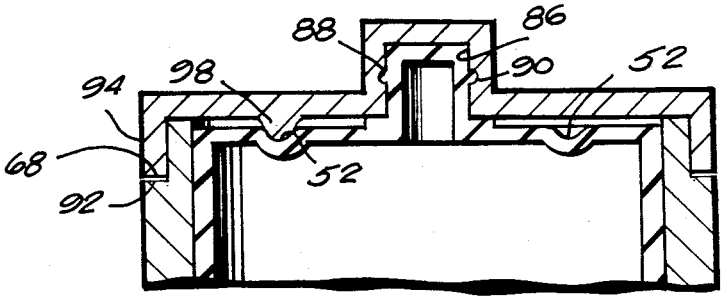

COMBINED MAILBOX AND SUPPORTING POST

BACKGROUND OF THE INVENTION

The typical rural mailbox or other mailbox meant to be stationed at roadside or curbside as opposed to being designed to be mounted directly on an outside wall of a house or other building is a horizontally elongated receptacle element surmounting an upright post. One problem with this traditional post-supported mailbox construction is the difficulty of securely fastening the mailbox on the post. A related problem is that such mailboxes frequently are sold separately from posts, so that the home builder or consumer must go to two sources for the respective components, and hope that a secure connection may be made between the mailbox and the post. A mailbox which extends laterally a substantial distance beyond the post to which it is secured has its distal structure inherently available as a moment arm for multiplying force applied to it in a sense to move the mailbox relative to the post. It is no wonder, then, that as conventional rural mailboxes are struck or otherwise wrenched by snow plows, vehicle-driving letter carriers having a momentary run of bad luck, drunk drivers or vandals, such mailboxes are all too frequently damaged, dislodged or knocked askew.

Some vertically-oriented, integrated with the supporting post mailboxes have been proposed in the prior art, but to the present inventor's knowledge, none has proved successful, presumably because they were too unusual to meet with official approval or consumer acceptance, and/or were too difficult and hence expensive to manufacture, and/or had design flaws which could not be overcome within the confines of the principles devised by their designers.

SUMMARY OF THE INVENTION

A mailbox receptacle is combined with a supporting post, on which it forms an upper portion characterized by a floor extending transversally across the interior of the tubular post at a level spaced somewhat below the upper end. A lateral opening is provided into the interior space above the floor, and a tubular sleeve is coaxially rotatably mounted on the upper end region of the structure. The tubular sleeve has a lateral opening which registers with the receptacle opening in one orientation of the sleeve. And the tubular sleeve may be rotated to fully close the receptacle opening. Stops are provided to define the angular extremes of rotary movement of the tubular sleeve, and the sleeve or a cap structure provided on the post over the sleeve may include a signal flag which, particularly in the latter case, may be caused to operate in conjunction with rotation of the sleeve in the course of opening or closing the receptacle. In one version, the sleeve rides on an upwardly facing circumferential shoulder defining the lower extent of a recessed portion of the post structure, so that the mailbox portion protrudes insignificantly radially outwards from the post portion of the post structure. Preferably the structure is made of a durable synthetic plastic resin.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing

FIG. 1 is an exploded perspective view of a combined mailbox and supporting post embodying principles of the present invention;

FIG. 2 is a fragmentary front elevational view thereof in a mounted condition; and FIG. 3 is a fragmentary longitudinal sectional view thereof taken substantially on line 3—3 of FIG. 1.

DETAILED DESCRIPTION

Figure 4:
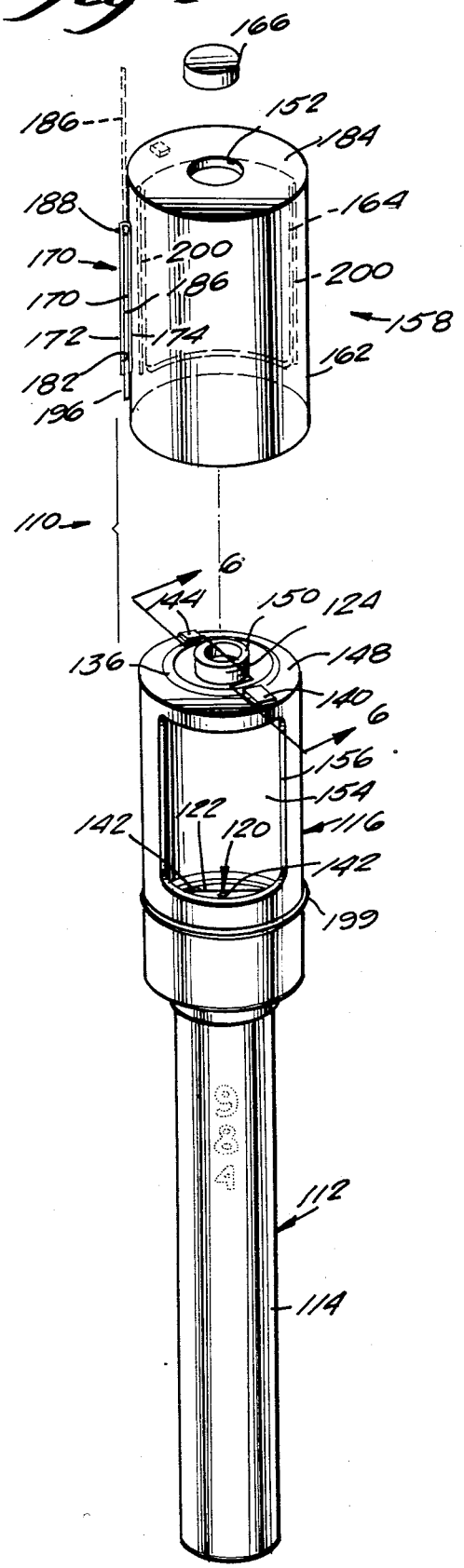
FIG. 4 is an exploded perspective view similar to FIG. 1, but of a simpler, presently preferred embodiment of the combined mailbox and supporting post.

An initially preferred embodiment of the combined mailbox and supporting post is shown in exploded perspective view at 10 in FIG. 1.

The main body of the device 10 is a post/receptacle unit 12, preferably integrally molded of a synthetic plastic resin such as injection molded polyethylene. However, it may be molded in parts, e.g. by a combination of extruding and injection molding, and the several parts united into a whole by use of any convenient technique, e.g. by thermal welding, solvent welding or the like.

The body 12 is shown comprising a generally tubular, upright post structure having a wall thickness, strength and durability comparable to those of plastic drain piping used in building construction and now-familiar highway sign standards and construction barricades fabricated of plastic tubing. So-called engineering plastics such as are beginning to be used in the fabrication of injection molded panels for the exteriors of automobile bodies may be used. In any event this post structure has a lower, post portion 14 which is physically integrated with an upper, receptable portion 16. At the juncture of these two portions, the longitudinal bore 18 of the body 12 is generally occluded by a preferably integrally formed transversally extending floor 20 which may advantageously be provided with a corrugated upper surface 22. Also at generally the same level, the body 12 is shown provided with an abrupt reduction in diameter so as to provide an axially upwardly facing, circumferentially extending shoulder 24.

The post portion 14 is shown being provided near its open lower end 26 with a plurality of angularly distributed holes 28 radially through its sidewall 30.

Referring briefly to FIG. 2 it can be seen that when the base of the post portion 14 is embedded in a footing 32 of wet concrete 34 poured into a hole 35 dug in the earth 38 bordering a road, street, driveway or the like, some of the concrete 34 flows through the submerged holes 28, so that as the concrete sets, a mechanical lock is formed through the holes 28 with the footing inside and outside of the base of the post.

If considered necessary or desirable, at an intermediate level, the post portion 14, below the level of the receptacle floor 20 may be provided with a transversally, e.g. diametrically oriented tube 36, opening through the post sidewall at 40 for receipt of a rolled newspaper. It is the inventors' present preference to omit providing such a newspaper-receiving tube, and one is illustrated merely to indicate how one could be provided were such a feature desired.

By preference, the receptacle floor 20, and the tube wall 36 (if such a tube is provided) at its bottom, are provided with a number of drain holes, 42, 44 so that if rain, snow or sleet were to enter the receptacle or tube, it would not collect there, but would run out of the holes 42, 44. The corrugations on the floor 20 of the receptacle, in combination with the drain holes through the floor make it easy for the mail to be supported in the receptacle above any small amount of rain water or the like which has entered the receptacle. One or more drain holes 46 may also be provided through the sidewall of the post portion, just above the footing, so that should water drain into the post through the holes 42 or 44, it may drain out of the post at its base. If need be, the hole or holes 46 may be fitted with grilles to prevent nesting within the post by birds, mice, chipmunks and the like.

The upper, receptacle portion 16 of the body 12 is shown occupying perhaps the upper approximately one-third of the body and being delimited at the top by an upper end wall 48 which preferably is integrally formed. A coaxially upwardly projecting boss 50 is shown being centrally provided on the upper end wall 48. A pair of eccentrically-located, radially intermediate detents 52 are also shown formed in the upper end wall 48.

Access to the cavity 54 defined by the walls of the receptacle portion 16 is by means of an opening 56 formed through the sidewall from the level of the floor 20 to a little below the upper end wall 48. In the instance depicted, the opening 56 is generally rectangular in outline and extends through about one-third of the circumference of the sidewall of the body 12.

The openable closure for the opening 56 of the receptacle cavity 54 is shown being provided in the form of a tubular sleeve 58, which is preferably molded of the same material and constructed by similar means as the body 12. The sleeve 58 is shown having a vertically oriented throughbore 60 having an internal diameter which is only slightly larger, e.g. ⅛ inch larger in diameter than the external diameter of the sidewall of the body 12 above the shoulder 24, and an external diameter which is preferably substantially equal to the external diameter of the post structure below the shoulder 24. Accordingly, when the closure sleeve 58 is telescopically coaxially received over the upper end of the post structure 12 and brought to rest on the shoulder 24, it is supported for rotation. The sidewall 62 of the sleeve 58 has an opening 64 formed through it, this opening having a location and an outline comparable to that of the opening 56, so that by rotating the closure sleeve 58 throughout about one hundred-twenty degrees the opening 56 may be alternatively fully opened and fully closed.

Adjacent and leading to its open upper end, the closure sleeve 58 preferably is externally provided with a circumferentially extending notch, recess or groove 66 which provides an upwardly facing circumferentially extending shoulder 68.

For ease in rotating the closure sleeve 58 for opening and closing the mailbox, a handle 70 is shown provided externally on the sidewall of the closure sleeve. By preference, and as shown, the handle 70 comprises a vertically-oriented bar 72 disposed beside the opening 64, e.g. slightly to the right of the opening 64 and connected to the sidewall 62, e.g. by radially directed, vertically spaced studs 74. By preference, the bar is so long that it extends a short distance below the lower shoulder 24 and a short distance above the upper shoulder 68. Accordingly, the lower end portion 76 of the handle 70 is positioned to engage stop bosses 78, 80 which are provided on the sidewall of the post portion just below the lower shoulder 24 for the purpose of delimiting the extremes of angular rotation of the closure sleeve so as to define fully open and fully closed positions.

By preference, a cap 82 with a disk-like upper end wall 84 and a circumferential depending skirt 94 is provided for the upper end of the mailbox. The cap end wall is shown being centrally provided with a hollow boss including an axially centrally disposed downwardly opening recess 86. This recess has a sidewall in which a circumferential groove 88 is formed. This permits the cap to be snapped into place on the upper end wall of the receptacle portion, the boss of which is similarly provided with a circumferential bead means 90 which is received in the groove 88. The lower edge 92 of the skirt 94 preferably is of about the same external diameter as and is juxtaposed with and may ride on the upper shoulder 68. By this means, the cap 82 is constructed and arranged to remain mounted to the mailbox receptacle portion but to be rotatable both with respect to the mailbox receptacle portion and to the closure sleeve.

For use as an indicator flag, the cap 82 may be externally provided on its end wall and/or on its skirt with a sector or other portion 96 having a distinctive color, e.g. red.

The underside of the cap 82 end wall may be provided with one or more protuberances 98 constructed and arranged to seat in the detents 52.

The skirt of the cap 82 preferably is provided with a radially outwardly projecting boss 99 constructed and arranged to be engaged by the upper end portion 100 of the handle of the closure sleeve.

In use, the structure 10 is set upright in the ground, preferably by being based in a concrete footing as is explained above with reference to FIG. 2. The preferred angular orientation of the structure 10 is such that the opening 56 of the mailbox receptacle cavity faces the direction that the letter carrier is expected to approach the mailbox from.

The letter carrier grasps the handle 70 which is against the left stop 78 and uses it to rotate the closure sleeve until the handle 70 engages the right stop 80, at which time the opening 64 through the closure sleeve is fully registered with the opening 56 through the sidewall of the receptacle sidewall. Outgoing mail which may be standing in the cavity is retrieved through the aligned openings by the letter carrier and incoming mail is stood in the cavity by the letter carrier, whereupon he or she rotates the handle 70 fully to the left against the stop 78 to close the mailbox.

(If need be the mailbox may be provided with aligned openings through the lower portion of the handle 70 and through the stop boss 78 so that the letter carrier may lock the mailbox in a closed condition.)

By preference, the cap 82 is so positioned on the mailbox that when the letter carrier rotates the closure sleeve to the right to open the mailbox, the boss 99 rides against the upper end portion of the handle 70, correspondingly rotating the cap and thereby angularly repositioning the flag 96. As the letter carrier closes the mailbox, the flag 96 remains at its new position, e.g. facing the road, street or driveway and thus indicating to the postal patron that the mail has come. As the postal patron, thus alerted, comes and removes the mail from the box he or she may simply manually rotate the cap back to its original position so as to be ready to automatically rotate to indicate the next delivery. The flag 96 is therefore constructed and arranged to be operated with no special attention or extra effort on the part of the letter carrier. The flag may be alternatively operated to indicate by prearranged positional code that there is outgoing mail in the box to be picked-up by the letter carrier even if no incoming mail exists for that particular postal patron. The detents and protuberances on the underside of the cap and on the top wall of the receptacle help to define the correct positions of the flag and keep the cap positioned where it has been placed.

By preference, the device 10 is molded largely or entirely of synthetic plastic material, preferably colored in the melt so that it is smooth-finished and colored all the way through the thickness of its walls, with the exception of the flag and an optionally applied postal patron name. Clearances between relatively movable parts should be kept as small as possible to deter entrance of rain, snow, sleet, dust and the like yet permit smooth operation.

Of course the construction 10 may be made in various sizes, and the post portion and mailbox portion may be relatively longer or shorter than as shown without departing from the principles of the invention. Purely for illustrative purposes, some exemplary dimensions are now given: the overall height of the body 12 may be 59.5 inches, the outer diameter of the post portion 6.25 inches, the sidewall thickness of the post portion 9/16 inch, of the receptacle and closure sleeve 0.25 inch, and the receptacle opening and closure sleeve opening measure 18.0 inches high by 120° angular extent; the closure sleeve may be 24.0 inches high, with its handle projecting upwards another 2.0 inches and downwards another 2.0 inches.

Figure 5:
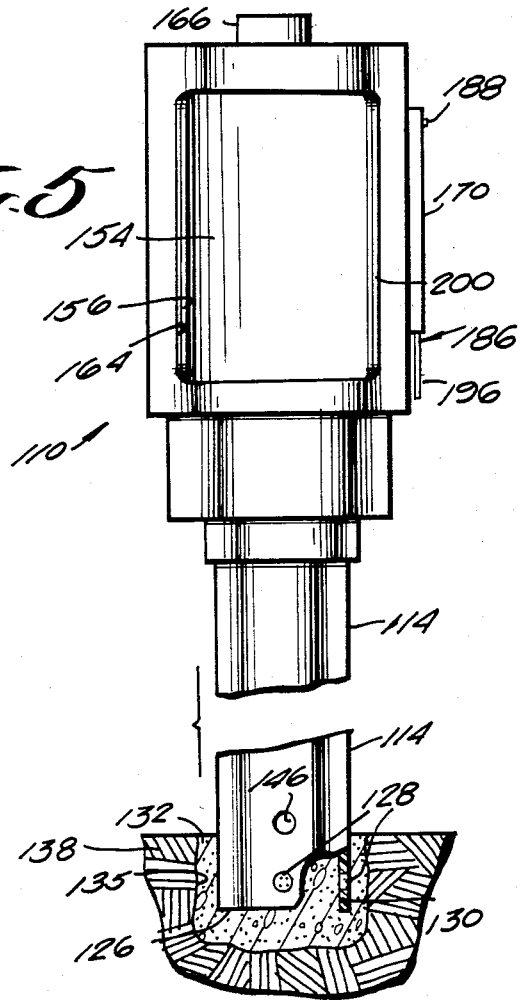
FIG. 5 is a fragmentary elevational view thereof comparable to FIG. 2.
Figure 6:
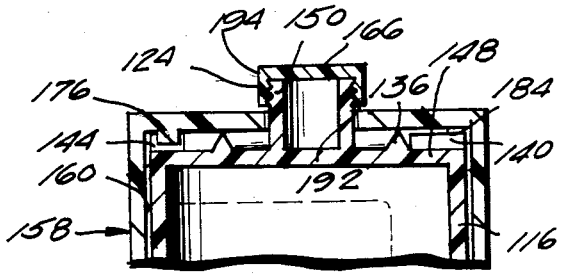
FIG. 6 is a fragmentary, enlarged scale longitudinal sectional view thereof on line 6—6 of FIG. 4, for comparison with FIG. 3.

A presently preferred embodiment of the combined mailbox and supporting post of the present invention is shown at 110 in FIGS. 4–6. In general, the presently preferred embodiment is similar to but simpler than the initially preferred embodiment. Accordingly, the following description will be focussed upon notable differences.

The main body of the device 110 is a post/receptacle unit 112, having a lower post portion 114 which is physically integrated with an upper, receptacle portion 116. At the juncture of these two portions, the longitudinal bore 118 of the body 112 is generally occluded by a preferably integrally formed transversally extending floor 120 which may advantageously be provided with a corrugated upper surface 122. Also at generally the same level, the body 112 is shown provided with an abrupt reduction in diameter so as to reduce the overall size and weight of the structure by making the post portion 114 smaller in diameter than the receptacle portion 116.

The post portion 114 is shown being provided near its open lower end 126 with a plurality of angularly distributed holes 128 radially through its sidewall 130.

Referring briefly to FIG. 5, it can be seen that when the base of the post portion 114 is embedded in a footing 132 of wet concrete poured into a hole 135 dug in the earth 138 bordering a road, street, driveway or the like some of the concrete 134 flows through the submerged holes 128 so that as the concrete sets, a mechanical lock is formed through the holes 128 with the footing inside and outside of the base of the post, as with the initially described embodiment.

By preference, the receptacle floor 120 is provided with a number of drain holes 142 so that if rain, snow or sleet were to enter the receptacle it would not collect there, but would run out through the holes 142. The corrugations 122 on the floor 120 of the receptacle, in combination with the drain holes 142 through the floor make it easy for the mail to be supported in the receptacle above any small amount of rainwater or the like which has entered the receptacle. One or more drain holes 146 may also be provided through the sidewall of the post portion, just above the footing, so that should water drain into the post through the holes 142, it may drain out of the post through the hole or holes 146 at its base. If need be, the hole or holes 146 may be fitted with grilles to prevent nesting within the post by birds, mice, chipmunks and the like, as with the initially described embodiment.

The upper receptacle portion 116 of the body 112 is shown occupying perhaps the upper approximately one-third of the body and being delimited at the top by an upper end wall 148 which preferably is integrally formed. A coaxially upwardly projecting boss 150 is shown being centrally provided on the upper end wall 148. The boss 150 is shown having an external band of helical threading 124.

At a radially intermediate location, the upper end wall 148 is shown being coaxially provided with an annular boss 136, preferably of generally triangular cross section so as to have an upwardly presented apex.

Also provided on the upper end wall 148 at two angularly spaced sites which are preferably effectively approximately one hundred-twenty degrees apart, are a pair of stop bosses 140, 144.

Access to the cavity 154 defined by the walls of the receptacle portion 116 is by means of an opening 156 formed through the sidewall from the level of the floor 120 to a little below the upper end wall 148. In the instance depicted, the opening 156 is generally rectangular in outline and extends through about one-third of the circumference of the sidewall of the body 112.

The openable closure for the opening 156 of the receptacle cavity 154 is shown being provided in the form of a cap-like sleeve 158 having a tubular sidewall 162 with an open lower end, and a disk-shaped upper end wall 184 having a central opening 152 that is slightly larger in diameter than the boss 150.

The sleeve sidewall 162 is shown having a vertically oriented, downwardly opening cylindrical cavity 160 having an internal diameter which is only slightly larger, e.g. one-eighth of an inch larger in diameter than the external diameter of the sidewall of the body 112 above the reduced-diameter post portion 114.

The underside of the upper end wall 184, within the cavity 160, is provided with a stop boss 176 constructed and arranged for alternative engagement with the stop bosses 140 and 144.

Accordingly, when the closure sleeve 158 is telescopically coaxially received over the upper end of the post structure 112, and the sleeve upper end wall 184 is brought to rest on the annular boss 136 on the receptacle upper end wall 148, the sleeve 158 is supported for rotation.

The sidewall 162 of the sleeve 158 has an opening 164 formed through it, this opening having a location and an outline comparable to that of the opening 156, so that by rotating the closure sleeve 158 throughout about one hundred-twenty degrees, the opening 156 may be alternatively fully opened and fully closed.

A retainer cap 166 having a band of internal threading 168 on its peripheral skirt is screwed onto the boss 150 at 124. The skirt 194 of the cap 166 has an outer diameter which is larger than the diameter of the central opening 152, but the skirt is sufficiently short that when the cap 166 is screwed on tight the lower end 192 of the skirt remains spaced slightly above and does not bind against the upper end wall 184 of the closure sleeve 158.

For ease in rotating the closure sleeve 158 for opening and closing the mailbox, a handle 170 is shown provided externally on the sidewall 162 of the closure sleeve 158. By preference, and as shown, the handle 170 comprises a vertically oriented bar 172 disposed beside the opening 164, e.g. slightly to the right of the right side edge of the opening 164, and connected to the sidewall with a thinner flange 174 which is constructed and arranged to leave a vertically oriented slot 182 opening away from the sleeve opening 164.

As the handle 170 is grasped and pushed or pulled to the right or left to rotate the closure sleeve, the stop boss alternatively engages the stop bosses 144 and 140 defining the extremes of counter-rotation at which the sleeve opening 164 is completely registered with the receptacle opening 156 (fully open position) and completely out of registration with the receptacle opening (fully closed position).

The mailbox 110 may be provided with a flag 186 in the form of a bar or other elongated structure having at least a free end portion 196 with a distinctive color, e.g. red. The flag 186 is pivoted to the sleeve sidewall 162 and/or the handle 170 near the upper end of the latter, e.g. by pin and slot means 188 which are constructed and arranged to permit the flag to be alternatively stowed in the handle slot 182 or rotated up and dropped slightly to an erect, held in place condition. In order to lower the raised flag, it is first lifted slightly, then rotated about the pin 188, down into the handle slot 182. When the flag is down and stowed, it protrudes downwardly, e.g. an inch or two below the lower extent of the handle 170 to facilitate grasping the flag to raise it.

In use, the structure 110 is set upright in the ground, preferably by being based in a concrete footing as is explained above with reference to FIG. 5. The preferred angular orientation of the structure 110 is such that the opening 156 of the mailbox receptacle cavity faces the direction that the letter carrier is expected to approach the mailbox from.

The letter carrier grasps the handle 170 and uses it to rotate the closure sleeve 158 until the opening 164 through the closure sleeve is fully registered with the opening 156 through the sidewall of the receptacle. Outgoing mail which may be standing in the cavity is retrieved through the aligned openings by the letter carrier and incoming mail is stood in the cavity by the letter carrier, whereupon he or she rotates the handle 170 fully to the left to close the mailbox. The flag 186 may be operated by the postal patron and/or the letter carrier in accordance with accepted practices for indicating according to an agreed code, e.g. that there is outgoing mail to be picked-up and/or that there is incoming mail which has been delivered.

By preference the device 110 is made of similar materials, by similar means, with similar clearances as has been described hereinbefore with regard to the initial embodiment 10. Further, by preference, the exterior of the sidewall 162 of the closure sleeve 158 is provided with a circumferential boss 199, preferably of generally triangular cross section, and located so as to underlap and act as a bearing for the lower margin of the inner periphery of the sidewall 162 of the closure sleeve 158. Thus, rubbing contact between the stationary and moving parts is limited to the narrow bands where the annular bosses 136 and 199 on the stationary part engage the moving part. Alternatively, either or both of the annular bosses 136, 199 could be provided at comparable locations on the moving part, i.e. in the cavity of the closure sleeve 158. A similar flange 200 may be provided on either part bounding the respective opening, or at least flanking one or both of the vertical side edges thereof for minimizing the possibility that moisture can enter the annulus between the stationary and moving parts, while minimizing rubbing contact between these parts.

The present invention contemplates all workable permutations and combinations of the features described herein, regardless of whether they have been described in relation to the embodiment of FIGS. 1–3 or the embodiment of FIGS. 4–6.

It should now be apparent that the combined mailbox and supporting post as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A combined mailbox and supporting post comprising:

an upright, vertically elongated generally tubular cylindrical body comprising sidewall means defining a lower, post portion having an upper, receptacle portion juxtaposed thereupon and united therewith;

transversally extending wall means provided in said body between said receptacle portion and said post portion and being constructed and arranged to serve as a floor for said receptacle portion;

means defining a radially directed opening through said sidewall means above said floor for providing access to within said receptacle portion;

means providing an upper end wall on said body for said receptacle portion; and a tubular cylindrical closure sleeve having a sidewall provided with means defining an opening radially therethrough, said closure sleeve being coaxially rotatably mounted on said body in surrounding relation to said sidewall means of said receptacle portion and being constructed and arranged for angular movement between one extreme wherein both of said openings are aligned so that mail may be inserted into and retrieved from the receptacle portion through said openings, and another extreme wherein said opening of said closure sleeve is entirely non-aligned with said opening of said receptacle portion and said closure sleeve fully closes said opening of said receptacle sleeve.

2. The combined mailbox and supporting post of claim 1, wherein:

said body is provided as an integral molding of synthetic plastic resin.

3. The combined mailbox and supporting post of claim 1, wherein:

said post portion has an open lower end and said sidewall means of said post portion, near said open lower end is provided with a plurality of angularly distributed, radially facing openings constructed and arranged to have wet concrete flow through them and set, as said body is set upright in a footing of wet concrete.

4. The combined mailbox and supporting post of claim 3, further including:

means providing drain openings through said floor of said receptacle portion; and means providing at least one drain opening through said sidewall means of said post portion above where the post portion would emerge from the footing, so that water which has entered the receptacle portion, for instance as rain when the receptacle portion was opened for insertion of mail, may drain from the receptacle portion into the post portion and then out of the post portion.

5. The combined mailbox and supporting post of claim 1, further comprising:

a flag cap rotatably mounted relative to the body, said flag cap having a flag defined thereon and means providing a feature projecting into rotationally interfering relation with means providing a cam on said closure sleeve, these features being constructed and arranged to so coact that as the closure sleeve is rotated to gain access to the receptacle position for inserting mail, said flag cap is automatically rotated to move the flag to an angular disposition indicative of there being mail within the receptacle portion.

6. The combined mailbox and supporting post of claim 5, wherein:

the closure sleeve further includes a handle which may be grasped and reversibly moved to the right and left for correspondingly rotating the closure sleeve on the body for opening and closing the receptacle portion;

said cam being provided by an upwardly projecting portion of said handle.

7. The combined mailbox and supporting post of claim 6, wherein:

said body is externally provided below said floor of said receptacle portion with two angularly spaced stops; and said closure sleeve is provided with cooperative stop means for alternative engagement with said stops of said body for defining respective opposite extremes of angular rotation of the closure sleeve on the body.

8. The combined mailbox and supporting post of claim 7, wherein:

said stop means is provided by a downwardly projecting portion of said handle.

9. The combined mailbox and supporting post of claim 8, wherein:

said body undergoes an abrupt reduction in diameter a short distance below said floor of said receptacle portion, by an amount which is on the order of the thickness of said sidewall means thereby defining a circumferentially extending upwardly facing shoulder; and said closure sleeve has a circumferentially extending sidewall having a thickness which is on the order of the thickness of said sidewall means, and an outer diameter which is at least approximately equal to that of said sidewall means of said post portion;

said closure sleeve being supported for rotation on said shoulder.

10. The combined mailbox and supporting post of claim 9, wherein:

said upper end wall is integrally formed on said body; and said combined mailbox and supporting post further includes means rotatably mounting said flag cap on said upper end wall.

11. The combined mailbox and supporting post of claim 1, wherein:

said body undergoes an abrupt increase in diameter a short distance below said floor of said receptacle portion, the diameter of the past portion being greater than the diameter of the receptacle portion by an amount which is on the order of the thickness of said sidewall means thereby defining a circumferentially extending upwardly facing shoulder; and said closure sleeve has a circumferentially extending sidewall having a thickness which is on the order of the thickness of said sidewall means, and an outer diameter which is at least approximately equal to that of said sidewall means of said post portion;

said closure sleeve being supported for rotation on said shoulder.

12. The combined mailbox and supporting post of claim 11, wherein:

said upper end wall is integrally formed on said body; and said combined mailbox and supporting post further includes:

a cap with an end wall and a depending circumferential skirt; and means rotatably coaxially mounting said cap on said upper end wall with said skirt surrounding an upper end portion of said sidewall means of said receptacle portion adjacent said upper end wall.

13. The combined mailbox and supporting post of claim 1, further comprising:

an upper end wall provided on said tubular cylindrical closure sleeve;

cooperative mounting and journalling means provided on said body upper end wall and on said closure sleeve upper end wall for securing said closure sleeve in place on said body in surrounding relation to said receptacle portion while permitting rotation of said closure sleeve relative to said body between said extremes.

14. The combined mailbox and supporting post of claim 13, further comprising:

cooperative stop means provided on said body upper end wall and on said closure sleeve upper end wall for limiting rotation of said closure sleeve relative to said body to rotation between said extremes.

15. The combined mailbox and supporting post of claim 1, wherein:

the closure sleeve further includes a handle which may be grasped and reversibly moved to the right and left for correspondingly rotating the closure sleeve on the body for opening and closing the receptacle means.

16. The combined mailbox and supporting post of claim 15, further comprising:

an elongated flag having a free end portion which is provided with a distinctive color such as red in order to provide a visual signal when said flag is upright and raised;

said handle including means providing a stowage slot for removably stowing said flag; and means adjustably mounting the flag on said closure sleeve for movement between a raised condition wherein said flag is upright and said free end portion is elevated in relation to said closure sleeve, and a lowered condition wherein said flag is for the most part stowed in said stowage slot of said handle and said free end portion is not elevated in relation to said closure sleeve.

17. The combined mailbox and supporting post of claim 1, further comprising:

an upper end wall provided on said tubular cylindrical closure sleeve;

first cooperative mounting and journalling means provided on said body upper end wall and on said closure sleeve upper end wall for securing said closure sleeve in place on said body in surrounding relation to said receptacle portion while permitting rotation of said closure sleeve relative to said body between said extremes; and second cooperative journalling means provided on said closure sleeve and said sidewall means within and near the lower extent of where said closure sleeve surrounds said sidewall means of said receptacle portion, said first and second cooperative journalling means being constructed and arranged for minimizing rubbing contact between said closure sleeve and said receptacle portion.

18. The combined mailbox and supporting post of claim 17, wherein:

the first-described said cooperative journalling means is constituted by a ring-shaped boss coaxially formed on one of the exterior of the upper end wall of said body and the interior of the upper end wall of said closure sleeve and this boss being constructed and arranged to ride on the other of the interior of the upper end wall of said closure sleeve and the exterior of the upper end wall of said body.

19. The combined mailbox and supporting post of claim 18, wherein:

the second-described said cooperative journalling means is constituted by a ring-shaped boss coaxially formed on one of the exterior of said sidewall means of said receptacle portion and the interior of said closure sleeve and this boss being constructed and arranged to ride on the other of the interior of said closure sleeve and the exterior of said sidewall means of said receptacle portion.

20. The combined mailbox and supporting post of claim 19, wherein:

both of said ring-shaped bosses are of generally triangular cross-sectional shape.

* * * * *